US008672017B2

(12) United States Patent
Makino et al.

(10) Patent No.: US 8,672,017 B2
(45) Date of Patent: Mar. 18, 2014

(54) METHOD FOR GREEN SAND MOLDING

(75) Inventors: Hiroyasu Makino, Toyokawa (JP); Ramrattan Sam, Kalamazoo, MI (US)

(73) Assignees: Sintokogio, Ltd, Aichi (JP); The Board of Trustees of Western Michigan University, Kalamazoo, MI (US)

( * ) Notice: Subject to any disclaimer, the term of this patent is extended or adjusted under 35 U.S.C. 154(b) by 0 days.

(21) Appl. No.: 13/190,070

(22) Filed: Jul. 25, 2011

(65) Prior Publication Data

US 2012/0132391 A1 May 31, 2012

(30) Foreign Application Priority Data

Nov. 26, 2010 (JP) ..... 2010-263283

(51) Int. Cl.
*B22C 9/02* (2006.01)

(52) U.S. Cl.
USPC ..... 164/20

(58) Field of Classification Search
USPC ..... 164/19–22, 200–202
See application file for complete search history.

(56) References Cited

U.S. PATENT DOCUMENTS

2009/0095437 A1* 4/2009 Hirata ..... 164/200
2010/0269998 A1* 10/2010 Landis et al. ..... 164/37
2011/0024071 A1* 2/2011 Hirata et al. ..... 164/22

FOREIGN PATENT DOCUMENTS

JP 11277183 A 10/1999

* cited by examiner

*Primary Examiner* — Kevin P Kerns
(74) *Attorney, Agent, or Firm* — Sughrue Mion, PLLC

(57) ABSTRACT

The present invention provides a method for green sand molding that prevents a bad casting by producing a mold that does not have a brittle surface. The method has the steps of filling the green sand into a flask while fluidizing the green sand by aeration at a pressure between 0.05 and 0.18 MPa, and squeezing the green sand that has been filled in the flask, wherein a mold is produced so that the friability of the mold is 10 or less. The friability is calculated by the following steps: putting the mold in a rotating cylindrical sieve that has a diameter of 177.8 min and. USA, sieve size No. 8, rotating the cylindrical sieve at 57 rpm for 60 seconds, dividing the weight of the sand that has passed through the sieve by the weight of the sand and multiplying the quotient by 100.

4 Claims, 7 Drawing Sheets
(3 of 7 Drawing Sheet(s) Filed in Color)

METHOD FOR GREEN SAND MOLDING

TECHNICAL FIELD

The present invention relates to a method for green sand molding by which a mold is produced from green sand.

BACKGROUND ART

Conventionally, when a mold is produced from green sand, the green sand is dropped into a flask by means of gravity and then the sand is squeezed. Alternatively the green sand is filled with compressed air at around 0.3 MPa and then the sand is squeezed. These are the common methods (for example, see Japanese Patent Laid-open Publication No. H11-277183).

In a manufacturing site, if a casting that has been cast by using green sand has a rough surface on it, a surface hardener is sprayed on it or the density of the green sand is increased by increasing the pressure for squeezing.

In a foundry that uses green sand, if the surface of a mold is brittle, a part of the sand drops from the surface when pouring molten metal. That part of the sand flows with the molten metal. Thus that causes a bad casting. To prevent green sand from becoming brittle after molding, a proper amount of moisture, bentonite, etc., are added to the green sand.

After the green sand is filled into a flask by gravity or aeration of compressed air, it is mechanically squeezed and compacted to a predetermined density. If it is filled into the flask by gravity, there may be variations in the density in some small areas. Further, the sand cannot be sufficiently filled into sections that have small diameters. If the green sand is filled by the aeration of compressed air, the moisture in it may be reduced while being filled, because air with a high pressure, such as 0.3 MPa, is used. Further, fine particles of bentonite may be blown out of the sand by the compressed air at the high pressure. Thus the bonding force between the particles of the sand may deteriorate. Therefore a sufficient strength may not be generated on the surface of the mold by squeezing. A mold that is brittle as discussed above may cause a bad casting.

Thus it is the object of the present invention to provide a method for green sand molding that prevents a bad casting by producing a mold that does not have a brittle surface.

SUMMARY OF INVENTION

The method for the green sand molding of the present invention comprises the steps of filling the green sand into a flask while fluidizing the green sand by aeration at a pressure between 0.05 and 0.18 MPa, and squeezing the green sand that has been filled in the flask, wherein a mold is produced so that the friability of the mold is 10 or less. The friability is a value that is calculated as follows: The mold is put in a rotating cylindrical sieve that has a diameter of 177.8 mm and USA sieve size No. 8. The cylindrical sieve is rotated at 57 rpm for 60 seconds. The weight of the sand that has passed through the sieve is divided by that of the sand that has been put into the sieve. The value is calculated by multiplying the quotient by 100.

By the present invention, the green sand is filled into a flask by aeration at a low pressure, i.e., 0.05 to 0.18 MPa. The sand is squeezed while the bonding strength between the particles of the sand is maintained. Further, the friability is kept at 10 or less. Thus a mold that has no brittle surface and where the possibility of providing a bad casting is reduced can be produced.

The basic Japanese patent application, No. 2010-263283, filed Nov. 26, 2010, is hereby incorporated by reference in its entirety in the present application.

The present invention will become more fully understood from the detailed description given below. However, the detailed description and the specific embodiment are only illustrations of desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

BRIEF DESCRIPTION OF DRAWINGS

The patent or application file contains at least one drawing executed in color. Copies of this patent or patent application publication with color drawing(s) will be provided by the Office upon request and payment of the necessary fee.

DESCRIPTION OF EMBODIMENTS

Figure 1:
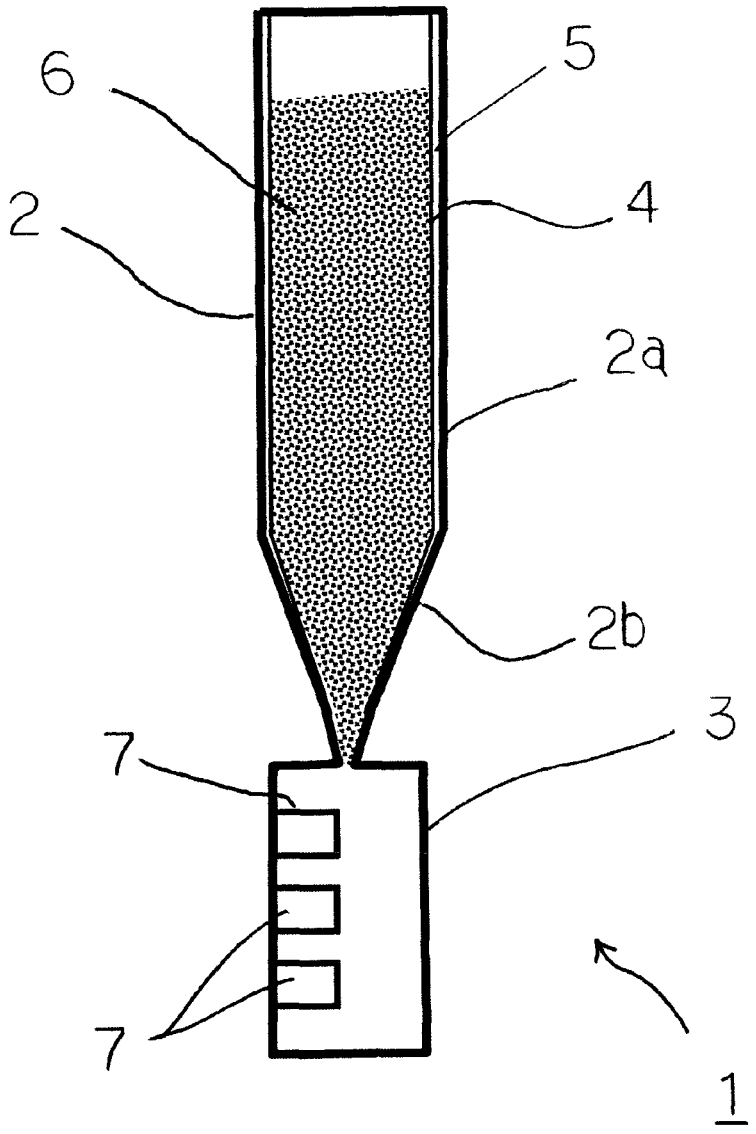
FIG. 1 is a schematic drawing of a device for carrying out the method for the green sand molding of the present invention.

Below the method for the green sand molding of the present invention is described with reference to the drawings. In the claims and the following description, the term "green sand mold" means a mold that is produced by green sand that is mainly composed of silica, bentonite acting as a bond, additives, and water. The green sand has been processed so as to have the characteristics of good moldability, strength, and properties of aeration. With reference to FIG. 1 the device 1 that carries out the method for green sand molding is described.

The device 1 for green sand molding of FIG. 1 carries out the method for producing a green sand mold that has no brittle surface. The device 1 employs sand filling by aeration at a low pressure. The device 1 comprises a sand tank 2 and a flask 3. The inner surface of the sand tank 2 is equipped with a porous body 4 acting as a filter. The porous body 4 has many holes that have a diameter of approximately 0.01 to 0.08 mm. For example, it is manufactured by sintering ultrahigh molecular weight polyethylene. The porous body 4 is arranged to be spaced apart from the inner surface of the sand tank 2.

Namely, a space 5 is formed between the porous body 4 and the sand tank 2. The space 5 is connected to a section for supplying air (not shown in the drawings). A valve that functions as a means for adjusting the pressure of the air is disposed between the space 5 and the section for supplying air.

Green sand 6 is stored in the sand tank 2. The green sand 6 is filled into a flask 3 by means of low-pressure aeration that is introduced through a side wall 2*a* and a tapered section 2*b* of the sand tank 2. Specifically, low-pressure air is introduced into the sand tank 2 through the holes of the porous body 4. The body 4 is located inside the side wall 2*a* and the tapered section 2*b*. While the green sand 6 in the sand tank 2 is being fluidized by the air, it is filled into the flask 3. The pressure in the sand tank 2 is adjusted to be at 0.05 to 0.18 MPa by a pressure sensor (not shown in the drawings) and by the means for adjusting the pressure of the air. Below the term "aeration filling" is used to refer to filling the green sand 6 into the flask 3 while fluidizing it by the low pressure air, as discussed above.

In the embodiment of FIG. 1, for example, a cylindrical sleeve 7 is disposed on the side of the flask 3 (for example, on the left side). By low-pressure aeration filling, the green sand 6 is filled in the sleeve 7.

By aeration filling, a small amount of expansion (which may be adiabatic expansion) causes the bentonite on the surface of the green sand to become active. Since the aeration is achieved under low pressure, the green sand is filled without reducing the moisture or losing the bentonite by the airflow.

After the green sand 6 is filled, the sleeve 7, which is filled with the green sand 6, is taken out from the flask. The weight of the green sand is adjusted to be the desired weight. Then a cylindrical test piece of green sand that is 50.8 mm in diameter and 50.8 mm in height is formed. The test for measuring the brittleness of the surface of the test piece is performed. The test is performed by using a friability-testing machine specified by the AFS (the American Foundry Society). The friability-testing machine measures the change of the weight of the test piece of green sand after it has been rolled on a rotating cylindrical sieve. Specifically, the test piece is put into a cylindrical sieve that has a diameter of 177.8 mm and USA sieve size No. 8 (that means a sieve having openings of 2.38 mm). The cylindrical sieve is rotated at 57 rpm for 60 seconds. The friability (unit: %) is calculated by multiplying 100 by the quotient of the weight of the sand that has passed through the openings of the rotating cylindrical sieve divided by that of the sand that has been put into the sieve. The friability is the value that shows the characteristics of the molding sand. Here it is used to measure the brittleness and stability of the surface. Namely, the friability is calculated by the following equation: the friability={(the weight of input sand−the weight of the test piece after rotation within the rotating sieve)/the weight of input sand}×100. Below the test for measuring the friability is also called a "friability test."

Figure 2:
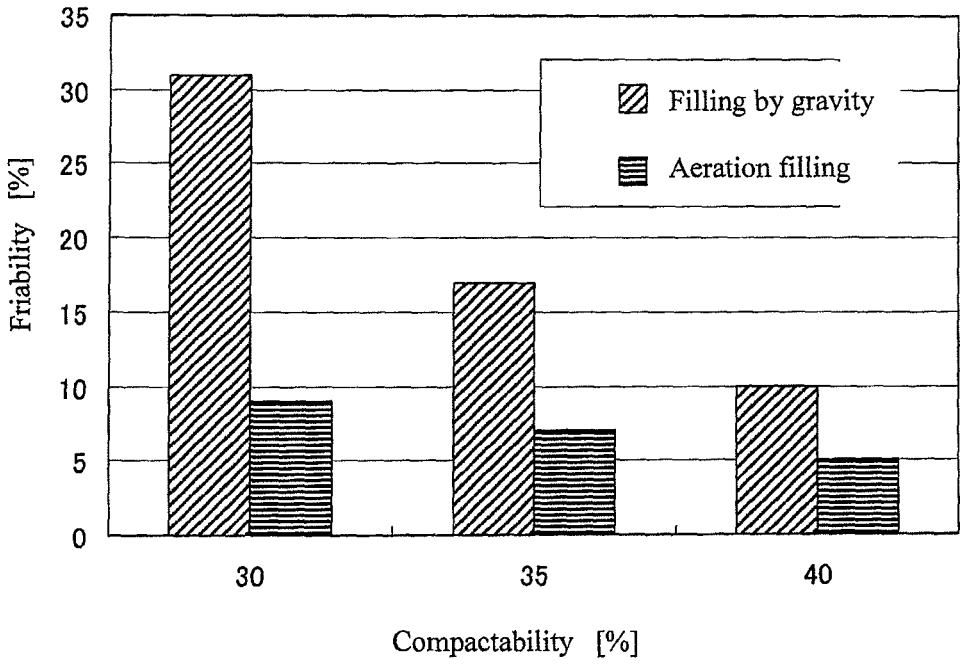
FIG. 2 shows the results of experiments for the molds that are produced by the method for green sand molding.

The results of the friability test are shown in FIG. 2. The results are under the conditions where compactabilities are adjusted to 30%, 35%, and 40% by controlling the moistures of the green sand. The compactability is a CB value that is calculated as follows. After passing through a sieve that has USA sieve size No. 6 the sand is filled into a sleeve for an experiment that has a diameter of 50 mm and a height of 100 mm. After carefully removing surplus sand, the sand is squeezed at a pressure of 10 kg/cm$^2$ or rammed three times. Then the shrinkage (mm) after being squeezed or tamped is measured. The CB value is calculated as CB=(the shrinkage/100)×100. In the experiment, though the pressure was set at 0.07 MPa, the measured pressure was approximately 0.06 MPa, like the case of FIG. 5, which will be discussed below. For a comparison, the results of the test pieces that are prepared by gravity filling of the sand into the sleeve are also shown.

The properties of the sand (lake sand from Michigan) that is used for the test are shown in Table 1. In Table 1, "AFS-GFN" denotes the liquidity index specified by AFS, "AFS Clay Content" the content of the clay, "LOI" the loss of ignition, "Shape" the shape of the sand, "Roundness/Sphericity" the degree of roundness, "Acid Demand Value" the acid consumption, "Turbidity" the turbidness, and "M. Blue Clay" the content of the active clay.

TABLE 1

| USA Sieve No. | % Retained |
|---|---|
| 6 | 0.0 |
| 12 | 0.0 |
| 20 | 0.0 |
| 30 | 0.2 |
| 40 | 2.5 |
| 50 | 19.4 |
| 70 | 34.2 |
| 100 | 30.2 |
| 140 | 10.8 |
| 200 | 2.4 |
| 270 | 0.3 |
| Pan | 0.0 |
| Screens | 4 |
| AFS-GFN | 61.53 |
| AFS Clay Content, % | 0.34 |
| LOI | 0.25 |
| Shape | Sub-Rounded |
| Roundness/Sphericity (Krumbein) | 0.7/0.7 |
| pH | 7.5 |
| Acid Demand Value (ADV, 7 pH) | 1.40 |
| Turbidity | 28 |
| M. Blue Clay, % (Total Clay 8% BOS) | 7.45 |

If the moisture or the compactability decreases, the surface of the test piece of the sand becomes more brittle or the friability as the index of the brittleness increases. In general, a friability that exceeds 10% is undesirable, since the sand of the mold may drop off during a casting process. The dropped portion may be contained in a cast, to thereby cause a bad casting. The experiment that uses a gravity filling shows a friability of 10% even when the compactability is 40%. If the compactability decreases, the friability will increase. Thus such a mold cannot be practically used in a foundry. In contrast, an experiment that used the aeration filling shows a friability of less than 10% when the compactability is 30%. During casting, a bad casting, such as when sand of a mold drops off, would not occur. Namely, the stability of the surface can be high even though the compactability is low.

Figure 3:
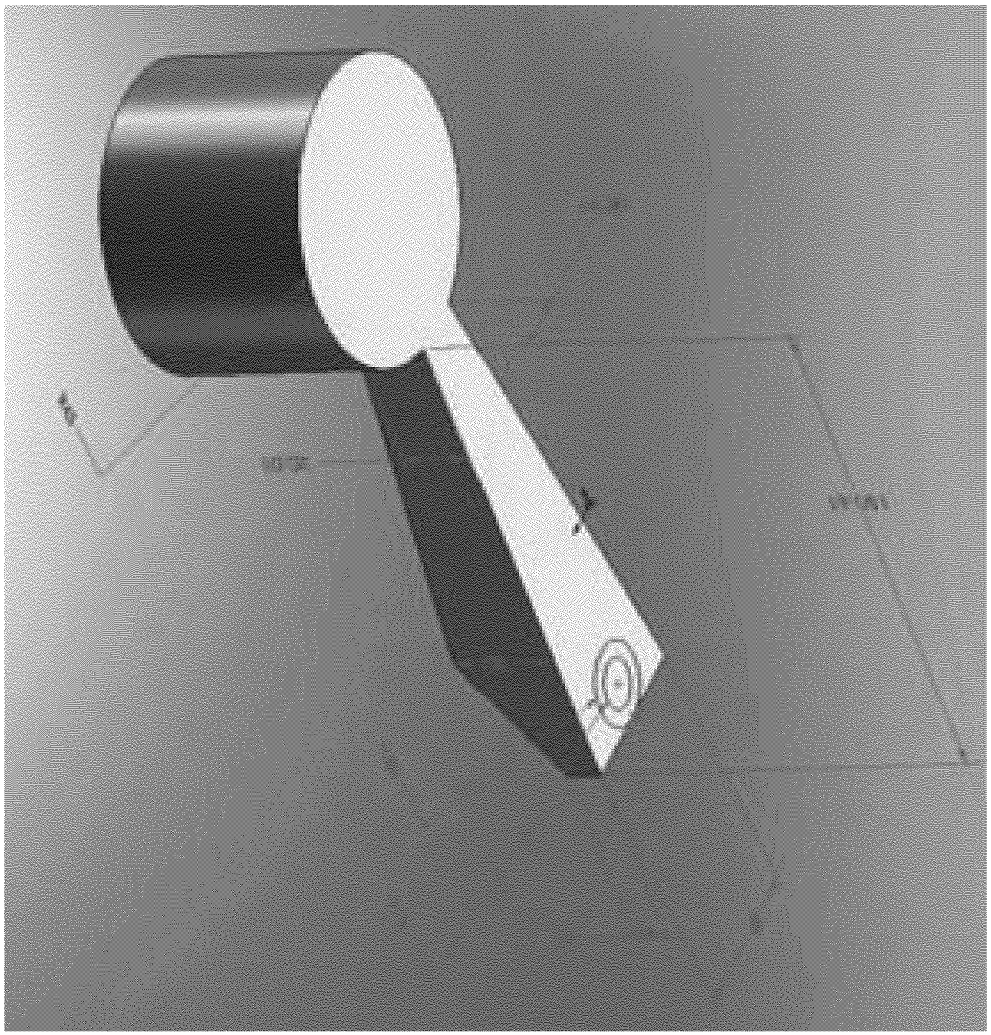
FIG. 3A illustrates the model of the pattern.
FIG. 3*b* illustrates an exemplary pattern that is used for the method for green sand molding.
Figure 3:
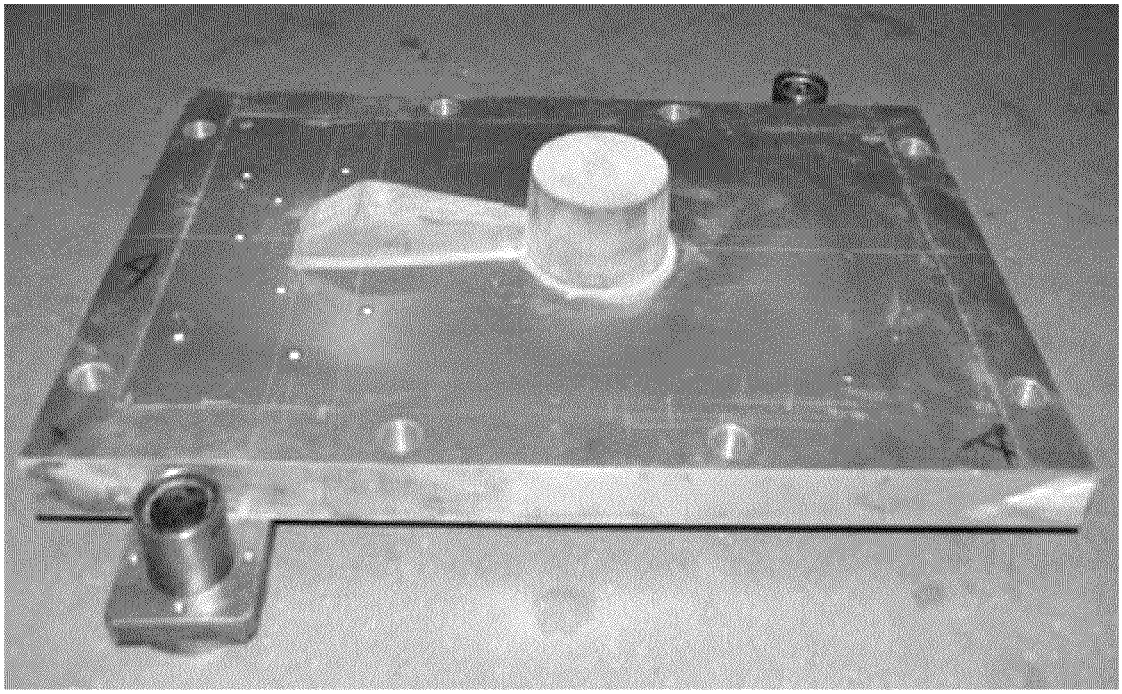
Figure 4:
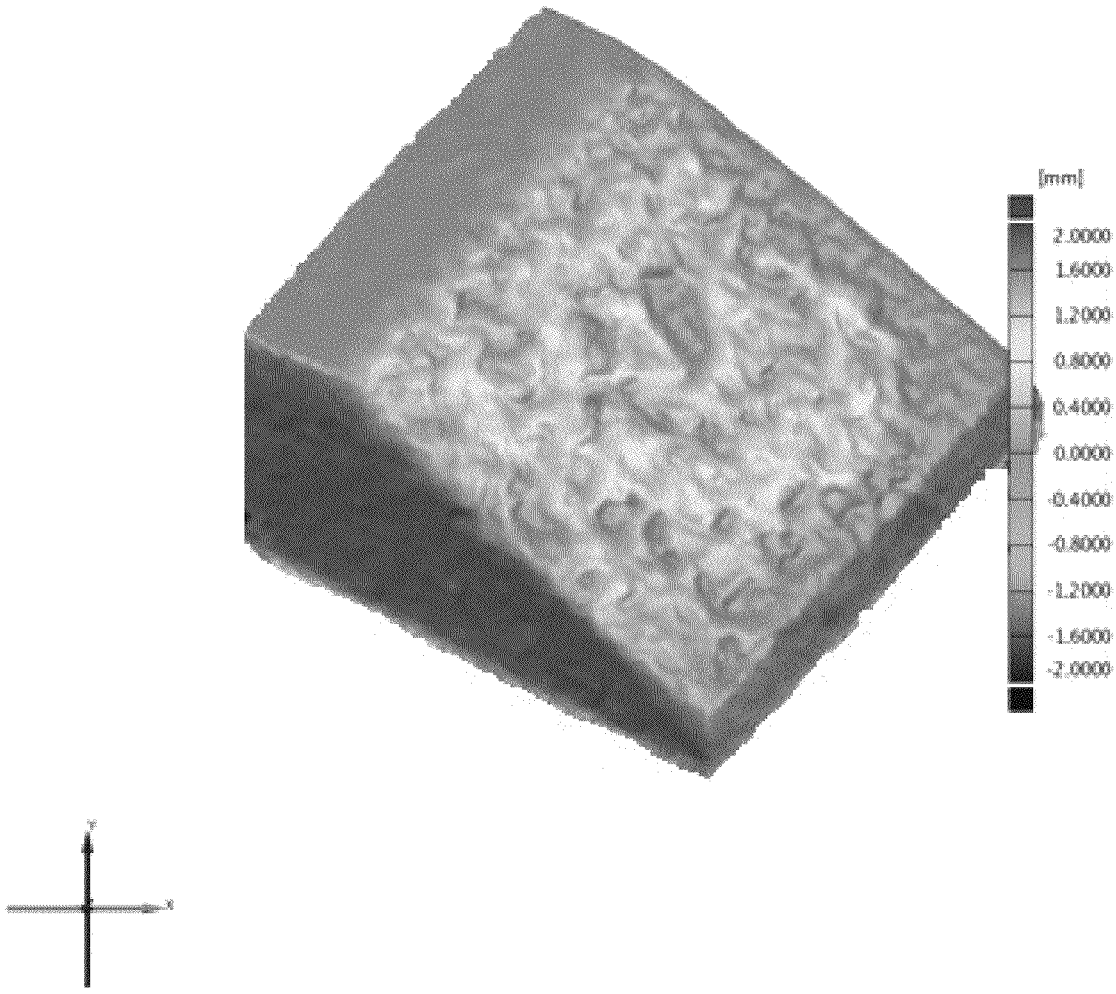
FIG. 4A illustrates the surface of the product after pouring.
FIG. 4B illustrates the surface of the casting that is manufactured by the mold that is produced by using the pattern of FIGS. 3*a* and 3*b*.
Figure 4:
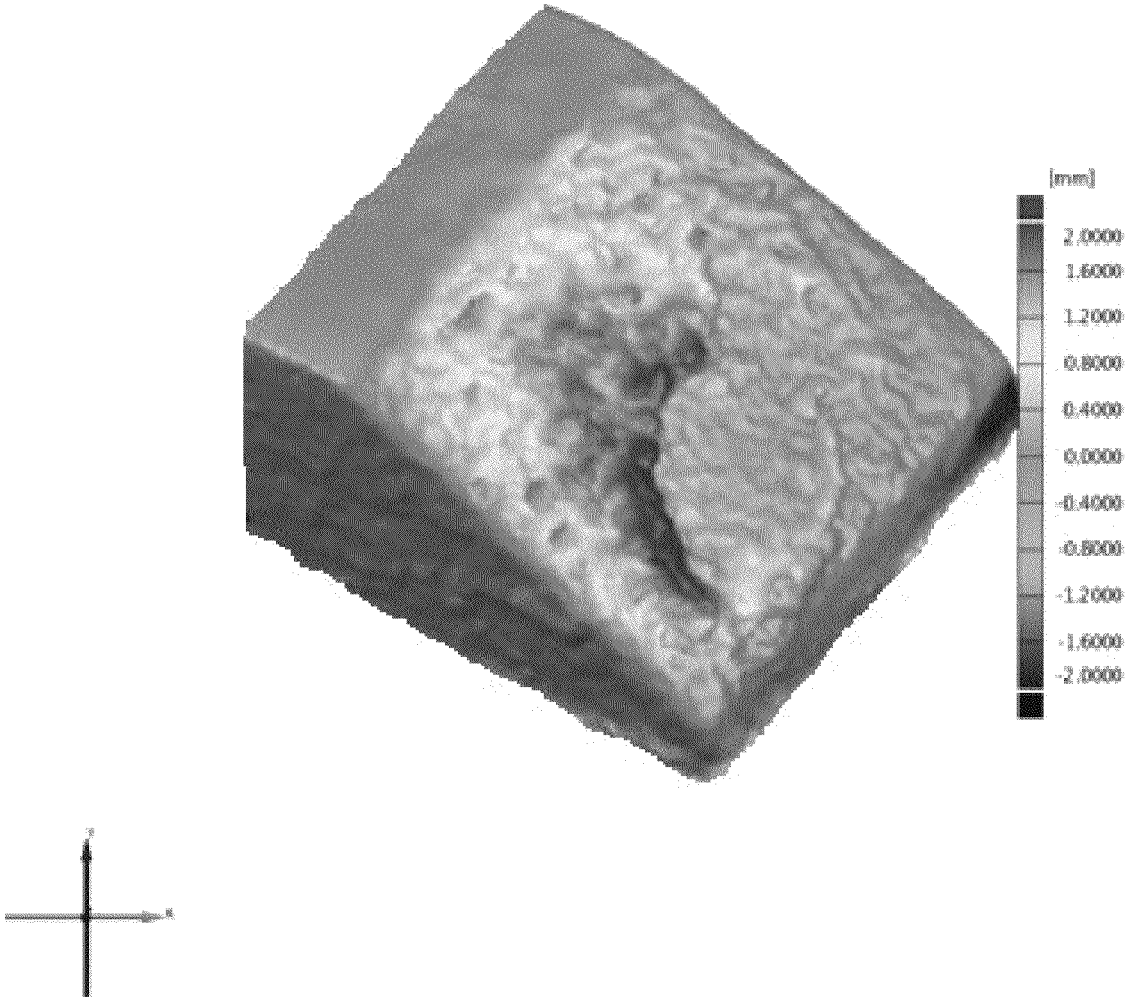
Figure 5:
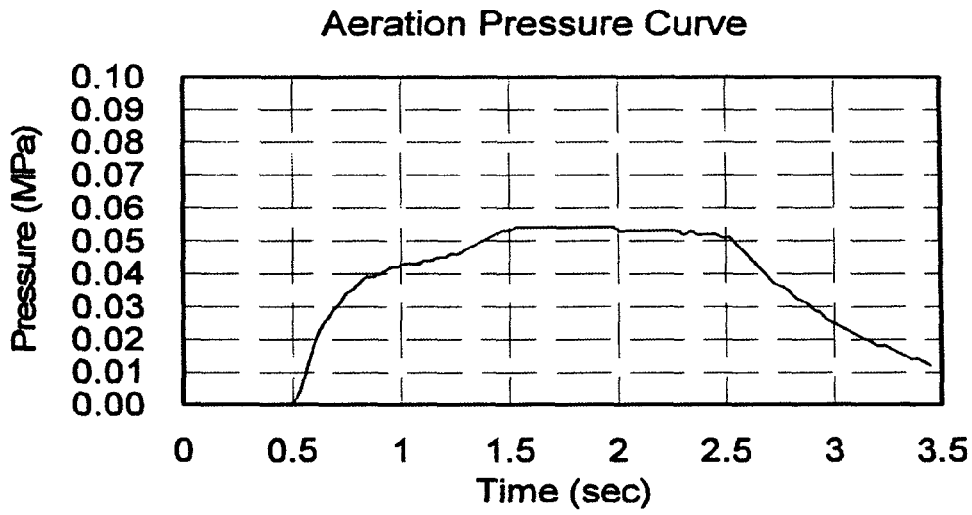
FIG. 5 shows a graph of the change of the pressure caused by the method for green sand molding.

Next, a test for pouring is performed by using the test pattern of FIG. 3, which has separately been prepared. The (green sand) mold is produced by aeration filling and mechanical squeezing. FIG. 3(*a*) illustrates the model of the pattern. FIG. 3(*b*) illustrates the pattern on the matchplate that is actually used. FIG. 4(*a*) shows the three-dimensional measurement of the surface of a product (cast) after pouring. As a comparative example, FIG. 4(*b*) shows the same measurement of a product that is cast by using a mold that has been produced by filling by gravity and squeezing. In the experiments, the pressure was set at 0.07 MPa. However, the pressure varied as shown in FIG. 5. It was approximately 0.06 MPa before, as well as after, pouring. The abscissa of FIG. 5 is the time, and the vertical axis is the pressure. As shown in FIG. 4, by filling by gravity, the surface of the product (cast)

has defects such as a rough casting surface. In contrast, by aeration filling the surface of the product is smooth and no defect is found.

As discussed above, by utilizing the low-pressure aeration filling, the bonding force among the particles of the sand is strong, and the surface of the green sand mold is not brittle. Thus the surface of the cast is smooth and no bad casting is expected.

As discussed above, by the present invention, since the aeration filling is utilized where green sand is filled into a flask by low-pressure compressed air, any moisture or bentonite that has adhered to the surfaces of particles of the sand is not blown out. A small amount of expansion activates the bentonite. The sand is squeezed while keeping a sufficient strength between the particles of the sand. Thus a mold that is not brittle on the surface can be produced. A bad casting is also prevented.

In other words, the inventors discovered that aeration affects brittleness (the stability of the surface), and that the brittleness affects the condition of the surface of a cast. They examined the appropriate range of the low-pressure aeration and the range of the friability that represents the brittleness. Then they conceived the present invention based on the facts that were obtained by the examination.

The method for the green sand molding of the present invention comprises the steps of filling green sand into a flask 3 by fluidizing the green sand at a pressure of 0.05 to 0.18 MPa, and squeezing the filled green sand. The method is characterized in that the friability of the mold is adjusted to be 10 or less. Since the green sand is filled into the flask by the low-pressure aeration and squeezed while the bonding force among the particles of the sand is maintained, and since the friability is 10 or less, a mold that is not brittle on the surface can be manufactured and the possibility of a bad casting is reduced By the present method, a cast that has the compactability within the range of 30% to 40% can be manufactured. So the range of the prior art has been expanded. Further, the mold is produced by sand where the particles have a high bonding strength, the mold being compatible with bentonite and without any vaporizing moisture being produced. Thus a mold that has a good quality is obtained.

The present invention is applicable to both a method that uses a device for producing a mold with a molding flask and a method that uses a device for producing a flaskless mold.

The invention claimed is:

1. A method for green sand molding comprising the steps of:

filling the green sand into a flask while fluidizing the green sand by low pressure aeration at a pressure between 0.05 and 0.18 MPa; and squeezing the green sand that has been filled in the flask;

wherein a mold is produced so that the friability of the mold is 10 or less, where the friability is a value that is calculated by the steps of:

putting the mold in a rotating cylindrical sieve that has a diameter of 177.8 mm and USA sieve size No. 8, which is a sieve having openings of 2.38 mm;

rotating the cylindrical sieve at 57 rpm for 60 seconds;

dividing the weight of the sand that has passed through the sieve by the weight of the sand that has been put into the sieve; and multiplying the quotient by 100.

2. The method for green sand molding of claim 1, wherein in the step of squeezing the compactability of the green sand is 30% to 40%.

3. The method for green sand molding of claim 2, wherein the green sand contains bentonite, wherein the bentonite is not lost as a result of the low pressure aeration.

4. The method for green sand molding of claim 1 further comprising measuring said friability after forming the mold.

* * * * *